US008573310B2

(12) United States Patent
Rouen

(10) Patent No.: US 8,573,310 B2
(45) Date of Patent: Nov. 5, 2013

(54) GAS LIFT APPARATUS AND METHOD FOR PRODUCING A WELL

(75) Inventor: Robert P. Rouen, Lindale, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1842 days.

(21) Appl. No.: 10/711,820

(22) Filed: Oct. 7, 2004

(65) Prior Publication Data

US 2006/0076140 A1 Apr. 13, 2006

(51) Int. Cl.
*E21B 43/00* (2006.01)

(52) U.S. Cl.
USPC ..... 166/372; 166/183

(58) Field of Classification Search
USPC ..... 166/372, 183, 189
See application file for complete search history.

(56) References Cited

U.S. PATENT DOCUMENTS 1,067,868 A * 7/1913 Dunn ..... 166/305.1
2,298,834 A * 10/1942 Moore ..... 166/54.1
2,725,014 A * 11/1955 Pryor ..... 417/111
2,798,558 A * 7/1957 McCulloch ..... 166/115
2,894,587 A * 7/1959 McCulloch ..... 166/123
3,003,563 A * 10/1961 Kenneday et al. ..... 166/114
3,192,869 A * 7/1965 McCarvell et al. ..... 417/115
3,664,427 A 5/1972 Deaton
3,680,637 A 8/1972 Raulins
3,814,545 A * 6/1974 Waters ..... 417/90
4,267,885 A * 5/1981 Sanderford ..... 166/250.01
4,392,532 A * 7/1983 Raggio ..... 166/372
4,424,862 A * 1/1984 Munari et al. ..... 166/168
4,545,731 A * 10/1985 Canalizo et al. ..... 417/86
4,649,994 A * 3/1987 Chaudot ..... 166/68
4,682,656 A 7/1987 Waters
4,708,595 A * 11/1987 Maloney et al. ..... 417/109
5,031,697 A * 7/1991 Wellington et al. ..... 166/250.12
5,875,852 A * 3/1999 Floyd et al. ..... 166/387

* cited by examiner

*Primary Examiner* — D. Andrews
(74) *Attorney, Agent, or Firm* — Jim Patterson

(57) ABSTRACT

A gas lift system is provided for use in unloading a fluid from a perforation interval of a subterranean well to facilitate producing gas from a gas-bearing formation. The system may include a packer having dual ports, a tubing string running from the surface to the packer for producing the well, and an injection tool extending below from the packer into the perforation interval. The injection tool may include at least one gas lift valve for injecting gas into the perforating interval of the well.

27 Claims, 8 Drawing Sheets

GAS LIFT APPARATUS AND METHOD FOR PRODUCING A WELL

BACKGROUND OF THE INVENTION

Field of the Invention

The present invention relates generally to subsurface well completion equipment for lifting hydrocarbons from subterranean formations with gas, and more particularly to a method and apparatus for unloading liquid from a gas well by injecting gas into the well via gas lift valves.

SUMMARY

One aspect of the present invention is a gas lift system for use in a subterranean well, comprising: (1) a packer having dual ports, (2) a tubing string running from the surface to the packer for producing the well from a zone below the packer via a port in the packer, and (3) a tubular member running below the packer and including at least one gas lift valve for injecting gas into the well at a zone below the packer via the other port in the packer.

In another aspect of the present invention, the tubular member extends from the packer downward to a perforating interval of the well.

In yet another aspect of the present invention, the tubing string includes at least one gas lift valve for injecting gas into the well at a zone above the packer.

Other or alternative features will be apparent from the following description, from the drawings, and from the claims.

BRIEF DESCRIPTION OF THE DRAWINGS

The manner in which these objectives and other desirable characteristics can be obtained is explained in the following description and attached drawings in which.

Figure 1:
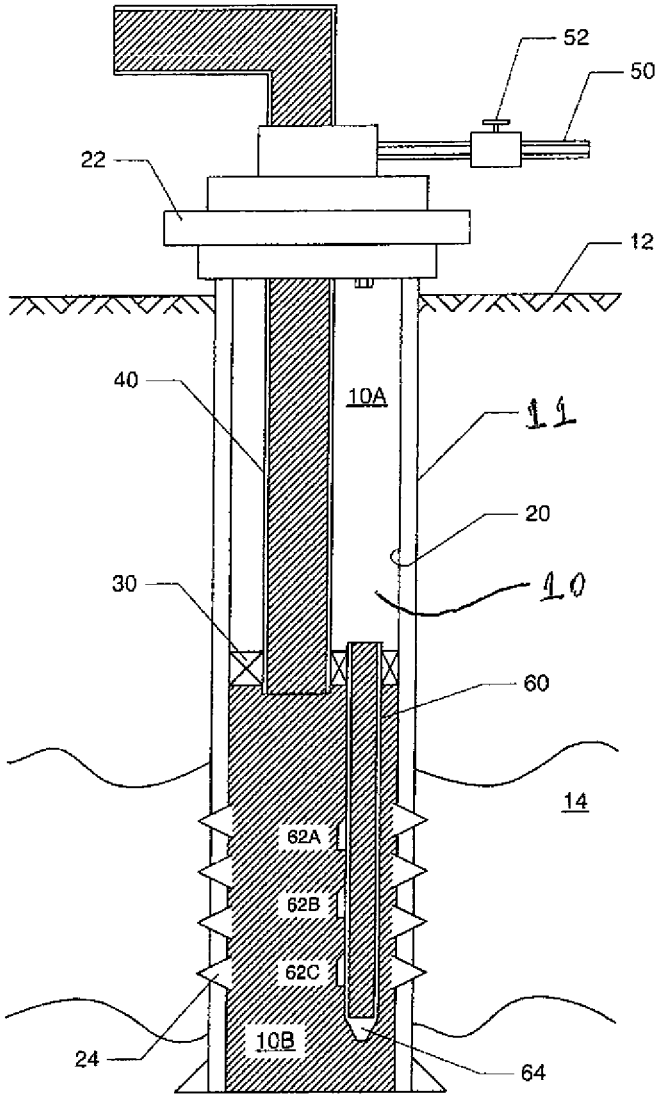
FIGS. 1-4 illustrate an embodiment of the gas lift system of the present invention for inserting gas into a well with gas lift valves located proximate to the perforation interval.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, the term "sealing mechanism" includes: packers, bridge plugs, downhole valves, sliding sleeves, baffle-plug combinations, polished bore receptacle (PBR) seals, and all other methods and devices for temporarily blocking the flow of fluids into or out of perforations in the formation.

Artificial lift systems are used to assist in the extraction of fluids from subterranean geological formations. For example, in gas wells, water is often produced with the gas and may accumulate at the bottom of the wellbore. If the column height of water in the well yields a greater hydrostatic pressure than the gas flowing from the formation, then the gas formation pressure becomes insufficient to move the gas in the well and hence gas production is hindered and/or decreased. In wells where this type of production decrease occurs, or if the formation pressure is low from the outset, artificial lift is commonly employed to enhance the recovery of gas from the formation. The present invention is primarily concerned with one type of artificial lift called "gas lift."

In order for gas to be produced utilizing gas lift, a precise volume and velocity of the gas flowing upward through the tubing must be maintained. Gas injected into the hydrostatic column of fluid (e.g., water) decreases the column's total density and pressure gradient, allowing the well to flow. As the tubing size increases, the volume of gas required to maintain the well in a flowing condition increases as the square of the increase in tubing diameter. If the volume and velocity (i.e., critical velocity) of the gas lifting the fluid is not maintained, the fluid falls back down the tubing, and the well suffers a condition commonly known as "loading up."

In general, the present invention regards a gas lift system and method of use for injecting gas in a gas-bearing well to unload a fluid. An embodiment of the gas lift system of the present invention includes an injection tool including one or more gas lift valves for injecting gas into a column of fluid within the perforation interval of a gas well. The injection tool is deployed downhole via a sealing mechanism—such as a dual-port packer—installed above the perforation interval. One port of the packer communicates the produced gas and fluid from the perforation interval to the surface via a string of tubing. The other port of the packer communicates an injection gas from the surface to the perforation interval via the deployed injection tool.

An embodiment of the gas lift system may be used for unloading an accumulated liquid (e.g., water, oil, and/or other well fluids) from a well having a perforation interval proximate a gas-bearing formation gas-bearing. If the hydrostatic pressure of the accumulated liquid exceeds pressure of produced gas, then the gas may not be produced. In operating the gas lift system, the formation is sealed using a sealing mechanism (e.g., a dual-port packer) in the well at a location above the perforation interval. A tubing string is provided for establishing communication between the surface and the well zone below the sealing mechanism. A gas injection tool having one or more gas lift valves is deployed in the well and provides communication between the surface (or a point above the sealing mechanism) and the perforation interval. A high-pressure gas is delivered from the surface into gas injection tool and into or proximate the perforation interval via the gas lift valves. By injecting gas in near the perforations, the hydrostatic pressure of the accumulated liquid may be reduced to a level sufficient to permit gas to be produced from the formation. The rising gas and liquid may be unloaded from the well via the tubing string.

More particularly, with respect to FIG. 1, an embodiment of the gas lift system of the present invention for unloading liquid from a gas well 10 includes an injection tool 60 having one or more gas lift valves 62A, 62B, 62C. The gas well 10 includes a casing 11 running from a surface location 12 through a gas-bearing formation 14 having perforations 24 therethrough. A dual-port packer 30 is provided to separate the well 10 into zones 10A and 10B. Zone 10A is typically a non-producing zone, while zone 10B typically includes a producing perforating interval. The wellhead 22 includes a mechanism for removing produced gas and fluid from the well 10 and a mechanism for providing gas to the well. The mechanism for removing produced gas and fluid from the well 10 is a tubing string 40 running from the surface 12 to zone 10B via a port in the packer 30. The mechanism for providing gas to the well is a gas line 50, which may include a valve 52 for controlling the inflow of gas into zone 10A of the well 10. The injection tool 60 is installed in the other port of the packer 30 and injects gas via the gas lift valves 62A, 62B, 62C into zone 10B of the well 10 proximate the perforations 24. The injection tool 60 may be a pipe, tubing, or other conduit with one or more gas lift valves for communicating between the annulus within the tool and the wellbore. Any type of gas lift valve may be employed in this operation including, but not limited to, injection pressure operation (IPO) valves, production pressure operated (PPO) valves, proportional response (PR) valves, and other gas lift valves.

Figure 2:
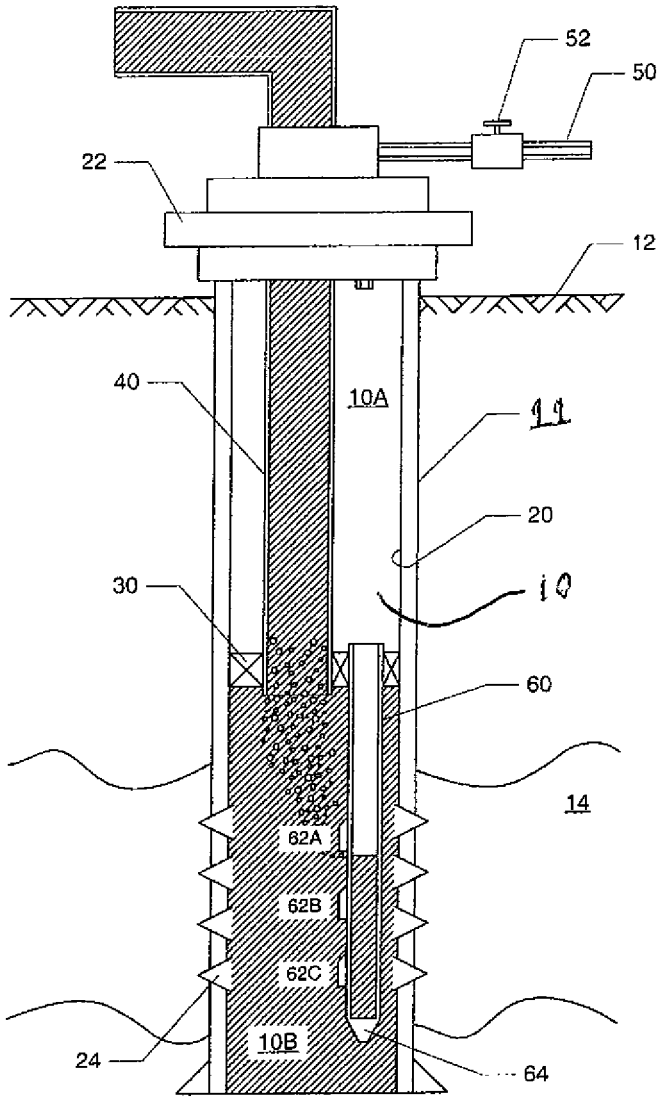
Figure 3:
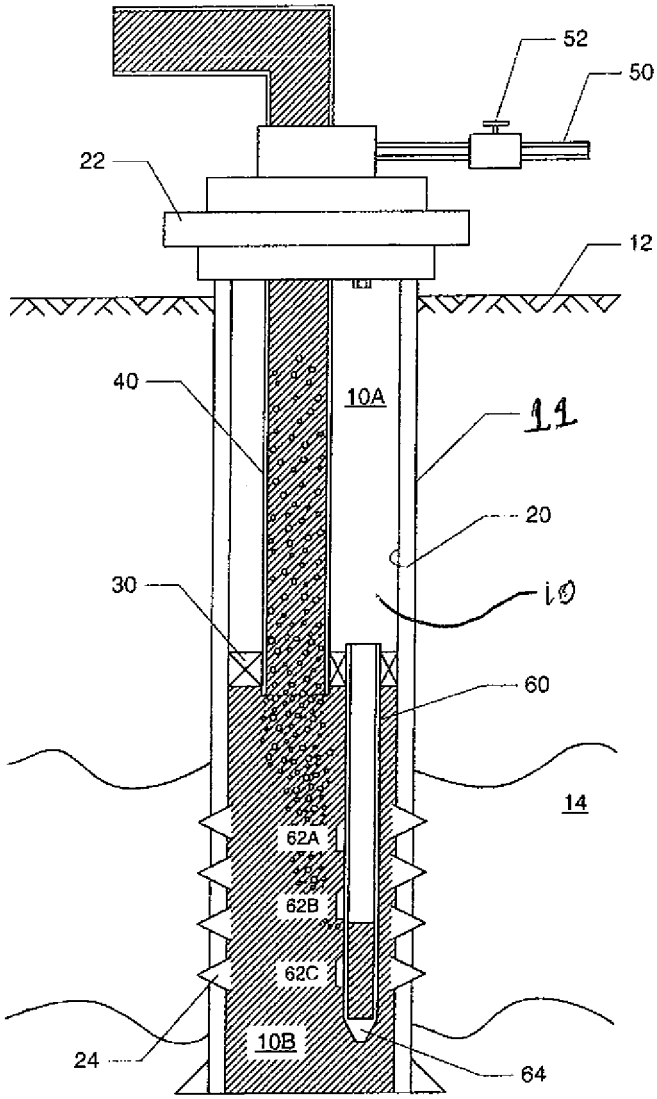
Figure 4:
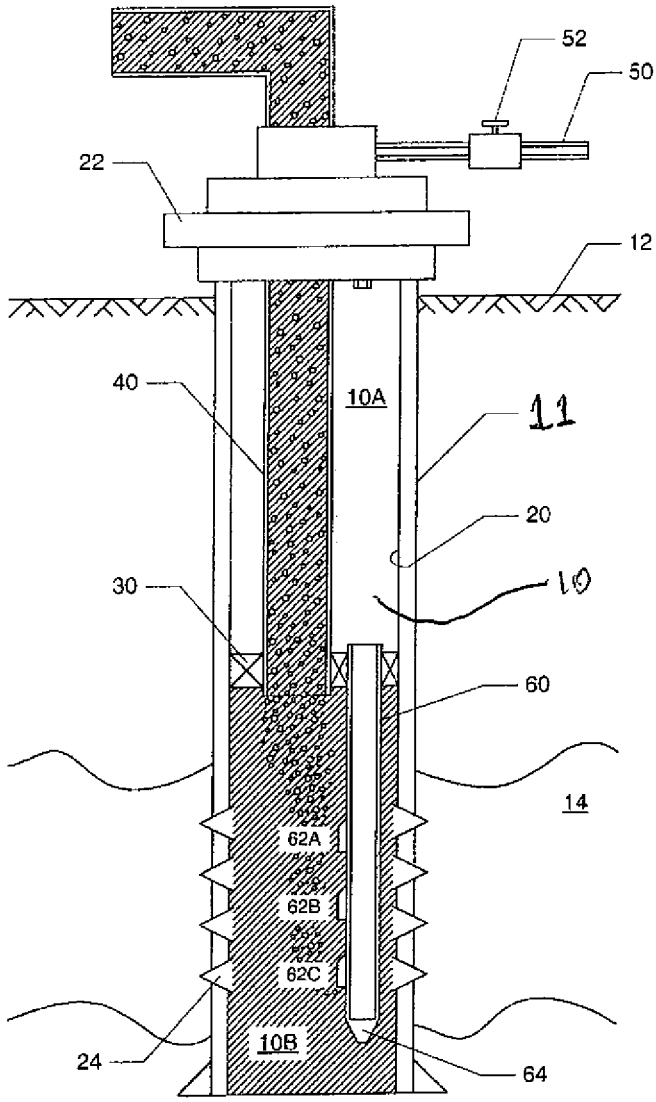

In operation, with respect to FIGS. 1-4, in the event that the well 10 is loaded up with a fluid (e.g., water) such that the velocity of the gas from the formation 14 falls below a critical velocity, gas may be injected into the well at or near the perforations 24 using the injection tool 60 to reduce the density and thus the pressure head of the fluid to re-achieve a production gas flow rate above the critical velocity. To accomplish this, a gas is introduced into the zone 10A above the packer 30 via a gas line 50 by actuating the valve 52. Once the gas pressure within the zone 10A above the packer 30 surpasses the selected actuating pressure to actuate the gas lift valve 62A, the valve 62A will open and gas will be injected into zone 10B of the well 10 proximate the perforations 24 (FIG. 2). As gas pressure is steadily increased, the next lower gas lift valve 62B is opened and the higher gas lift valve 62A is closed such that gas is injected into the well 10 proximate the perforations 24 at an even lower depth (FIG. 3). Finally, as gas pressure is further increased, the lowest gas lift valve 62C is opened and the higher gas lift valve 62B is closed such that gas is injected into the well 10 proximate the perforations 24 at a still lower depth (FIG. 4). The injection of gas at these depths (e.g., 5,000 ft below the surface or more) lowers the density of the fluid and thus facilitates unloading the fluid from the well to re-achieve super critical gas velocities. Furthermore, by lowering the hydrostatic pressure in the well at the perforations 24, the recovery of gas is facilitated by reduction of cross-flow and thief zone occurrences.

Figure 5:
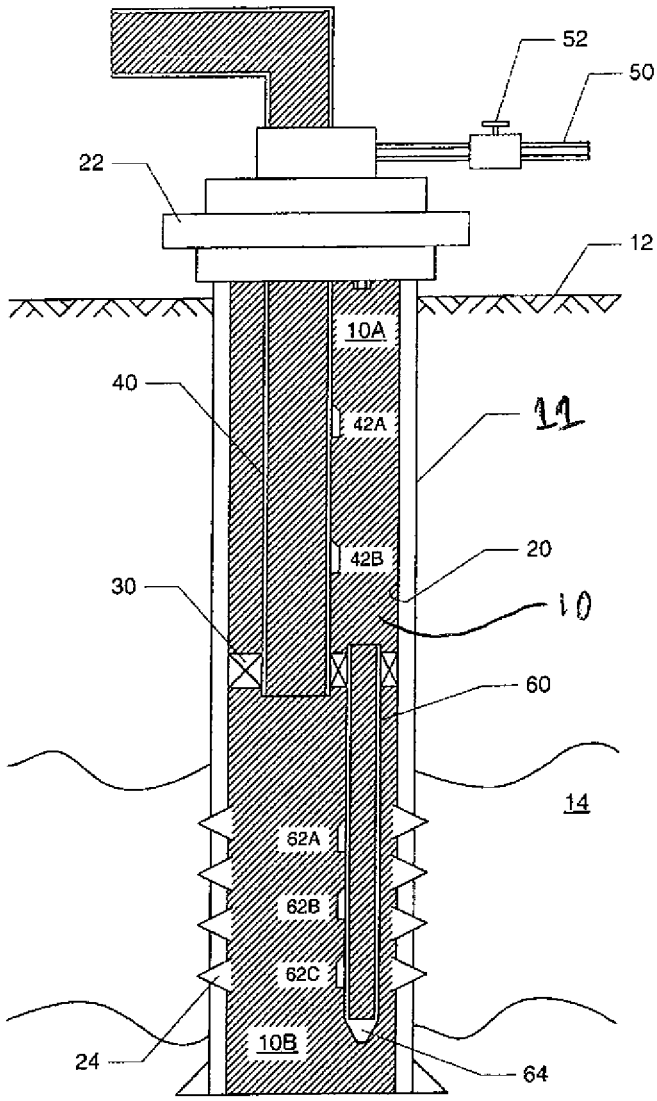
FIGS. 5-6 illustrate an embodiment of the gas lift system of the present invention for inserting gas into a well with gas lift valves located both proximate to the perforation interval and above the perforating zone to unload a liquid from the well.
Figure 6:
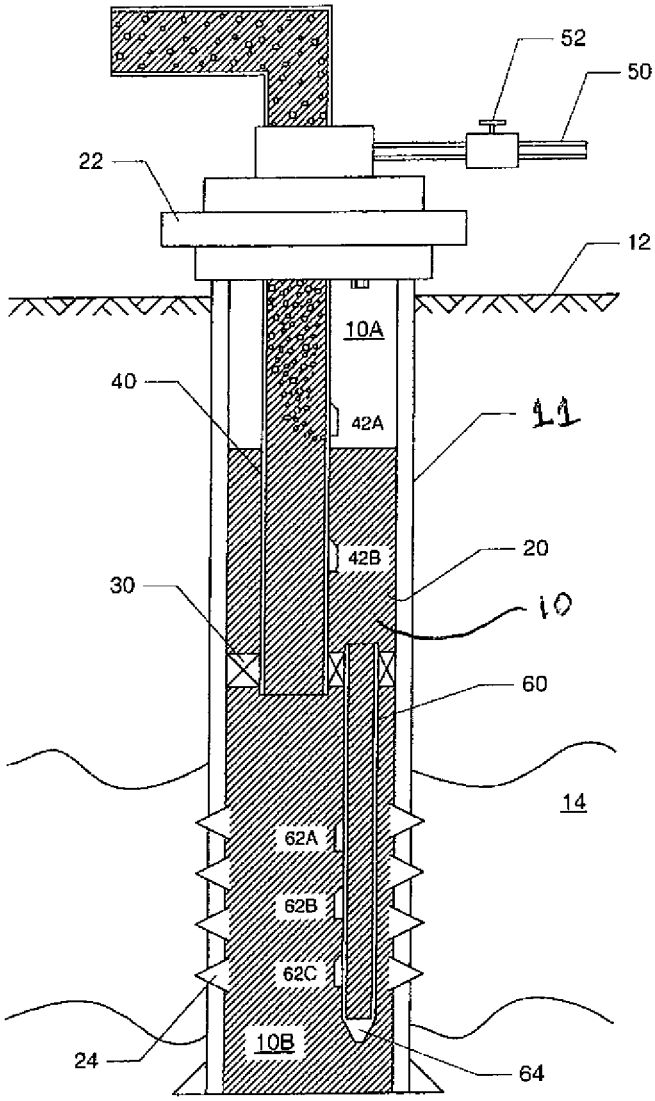

With respect to FIGS. 5-6, in another embodiment of the gas lift system of the present invention, the tubing string 40 includes valves 42A, 42B for unloading accumulated annular liquid from zone 10A above a dual-port packer 30. Also, an injection tool 60 having one or more gas lift valves 62A, 62B, 62C is installed below the packer 30 as described in the embodiments above. This system allows for providing unloading annular fluid in zones 10A and 10B. In operation, a gas introduced into the zone 10A above the packer 30 via a gas line 50 may actuate the valve 52. Once the gas pressure within the zone 10A is increased to a predetermined level, valve 42A will open and the accumulated liquid level in zone 10A will begin to drop as liquid is unloaded to the surface 12. As gas pressure is steadily increased, the next lower valve 42B is opened and the higher valve 42A is closed such that liquid may be unloaded at an even lower depth. Finally, once the annular zone 10A above the packer 30 is unloaded, gas may be injected into zone 10B of the well 10 proximate the perforations 24 as described above and shown in FIGS. 1-4.

While embodiments of the gas lift system and injection tool have been described with respect to unloading fluid (e.g., water) from a perforation interval to produce gas from a gas-bearing well, it is also intended that other embodiments of the present invention include a gas lift system and injection tool for injecting gas into a perforation interval of an oil-producing well to facilitate lifting oil from the formation to a surface location.

Figure 7A:
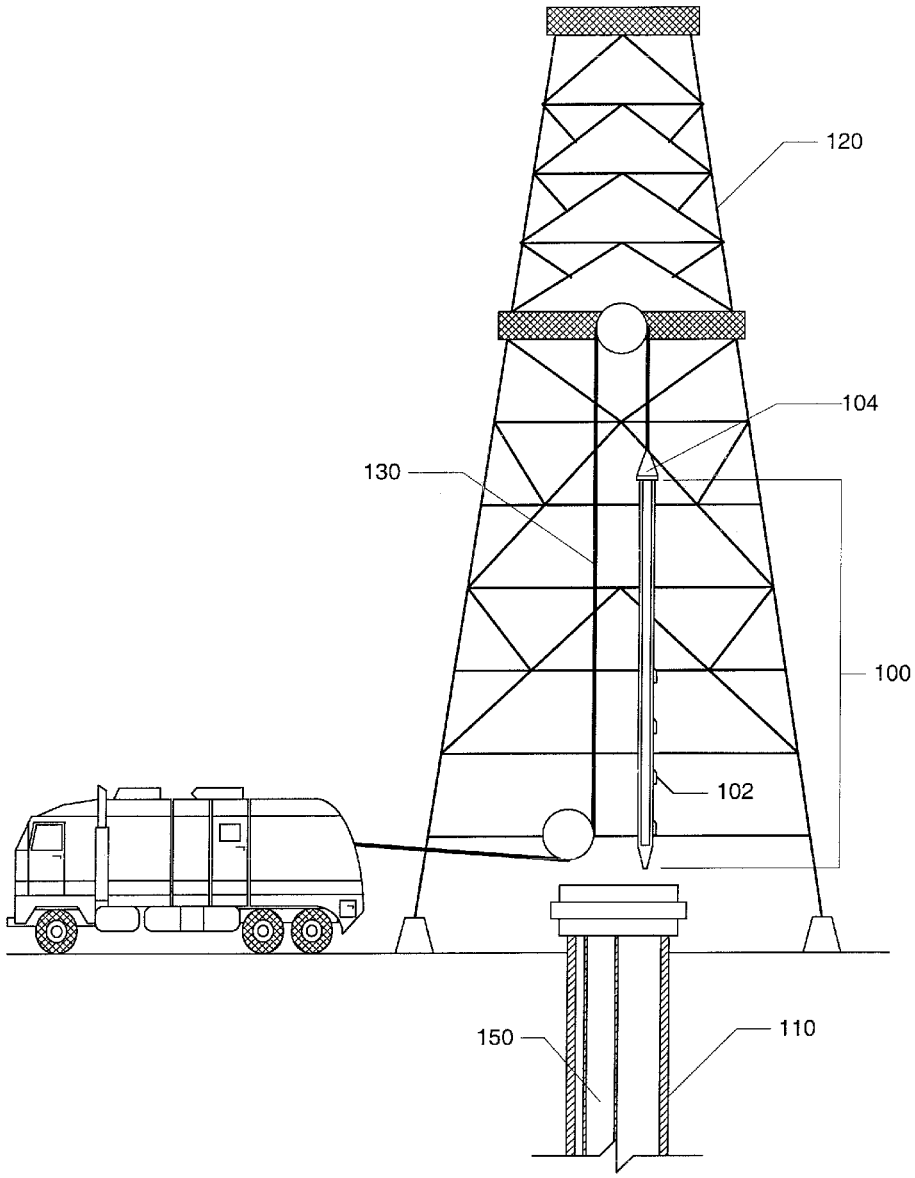
FIGS. 7A-7C illustrate an embodiment of the present invention for deploying a gas lift system in a gas well at the perforating interval.
Figure 7C:
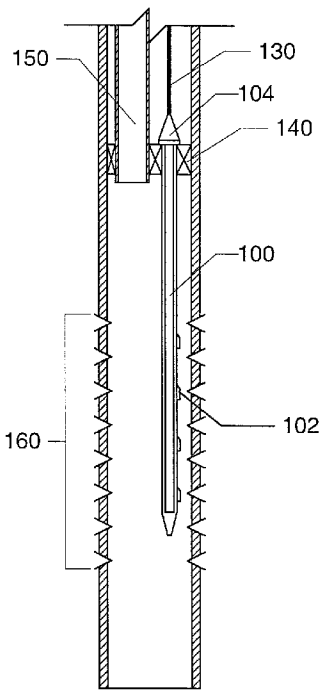
Figure 7B:
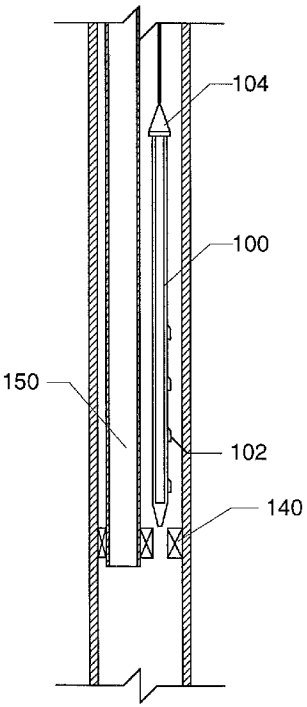

With respect to FIGS. 7A-7C, an injection tool 100 having gas lift valves 102 may be installed in a well 110 using a surface rig 120 (e.g., a workover rig). The injection tool 100 may be deployed by a line 130 (e.g., wireline or slickline) or conveyed on a tubing string. In the embodiment shown in FIG. 7A, the injection tool 100 is connected to a line 130 via a connector 104. In some embodiments, the connector 104 is a hook or latch mechanism allowing the tool 100 to be retrieved once deployed downhole. The injection tool 100 is run down hole on the line 130 and deployed through a port in a packer 140. A production tubing string 150 may be deployed through another port in the packer 140. The injection tool 100 is installed in the packer 140 such that the gas lift valves 102 are arranged at a depth proximate a perforation interval 160 in the well 110.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A gas injection tool, comprising:

a tubular member defining an axial bore therethrough, the axial bore adapted to deliver a gas into a wellbore proximate a perforation interval via orifices, wherein the gas injection tool is separate from and not in contact with a tubing string for removing fluid from the wellbore; and a plurality of gas lift valves attached to the tubular member, the gas lift valves adapted to regulate communication, via the corresponding orifices, from the axial bore of the tubular member to the wellbore at or below the perforation interval, and wherein the gas lift valves are configured to be opened in response to application of pressure applied by a flow of gas injected into the axial bore of the tubular member, wherein the gas is injected through each of the gas lift valves that is opened to assist production of fluid from the wellbore.

2. The gas injection tool of claim 1, wherein the tubular member is configured to engage a sealing mechanism that seals the wellbore above the perforation interval.

3. The gas injection tool of claim 1, wherein the tubular member is adapted to inject a gas proximate the perforation interval of a gas-bearing well.

4. The gas injection tool of claim 1, wherein the tubular member is adapted to inject a gas proximate the perforation interval of an oil-bearing well.

5. The gas injection tool of claim 1, further comprising a retrieving element attached to the tubular member.

6. The gas injection apparatus of claim 1, wherein the gas lift valves are arranged on a side of the tubular member to enable injected gas to pass in a radial direction of the tubular member into the wellbore through the corresponding orifices.

7. The gas injection apparatus of claim 1, wherein a first of the gas lift valves is actuated in response to the gas reaching a first gas pressure, and a second of the gas lift valves is actuated in response to the gas reaching a second, different gas pressure.

8. The gas injection apparatus of claim 7, wherein the first gas lift valve is closed once the delivered gas reaches the second pressure.

9. The gas injection apparatus of claim 1, wherein the plurality of gas lift valves are located at or below the perforation interval.

10. The gas injection tool of claim 1, wherein the gas lift valves provided as part of the tubular member of the gas injection tool allows the gas lift valves to be separate from the tubing string.

11. The gas injection tool of claim 1, wherein the gas injection tool is configured to be deployable into the wellbore separately from the tubing string.

12. A gas lift system for use in producing a well having a perforation interval, the system comprising:

a sealing mechanism adapted to seal the well at a location above the perforation interval, the sealing mechanism having two ports therein;

a tubular string adapted to produce fluid from the perforation interval via one port in the sealing mechanism; and an injection tool separate from and not in contact with the tubular string to inject gas into the well at or below the perforation interval via the other port in the sealing mechanism, the injection tool having plural gas lift valves for delivering the injected gas into the well at a location below the sealing mechanism and at or below the perforation interval, wherein the injection tool is to receive a flow of gas and the plural gas lift valves are configured to be opened by pressure applied by the flow of gas to inject gas into the well, wherein the gas is injected through each of the gas lift valves that is opened to assist production of fluid from the well.

13. The gas lift system of claim 12, wherein the tubular string comprises one or more gas lift valves for injecting a gas into the well at a location above the sealing mechanism.

14. The gas lift system of claim 12, wherein the sealing mechanism is a dual-port packer.

15. The gas lift system of claim 12, wherein the well is a gas-bearing well.

16. The gas lift system of claim 12, wherein the well is an oil-bearing well.

17. The gas lift system of claim 12, wherein a first of the plural gas lift valves is actuatable in response to the gas reaching a first gas pressure, and a second of the plural gas lift valves is actuatable in response to the gas reaching a second, different gas pressure.

18. The gas lift system of claim 17, wherein the plural gas lift valves are configured to sequentially actuate in response to the injected gas reaching different pressures.

19. The gas lift system of claim 12, wherein provision of the gas lift valves on the injection tool allows the gas lift valves to be separate from the tubular string.

20. The gas lift system of claim 12, wherein the injection tool is configured to be deployable into the well separately from the tubular string.

21. A method for unloading an accumulated liquid from a well having a perforation interval proximate a gas-bearing formation, wherein hydrostatic pressure of the accumulated liquid exceeds pressure of produced gas, the method comprising:

sealing the formation in the well at a location above the perforation interval;

providing a tubing string for establishing communication between surface and a point below the sealing location;

providing a gas injection tool having a plurality of gas lift valves for establishing communication between a point above the sealing location and the perforation interval below the sealing location, wherein the gas injection tool is separate from and not in contact with the tubing string;

delivering gas to the gas injection tool, wherein the delivered gas applies pressure to cause the plurality of gas lift valves to open;

delivering gas into the well at or below the perforation interval via the plurality of gas lift valves when opened to decrease the hydrostatic pressure of the accumulated liquid to a level sufficient to permit gas to be produced from the formation; and removing the accumulated liquid and gas from the well via the tubing string.

22. The method of claim 21, wherein providing the gas injection tool comprises deploying the gas injection tool into the well separately from the tubing string.

23. A gas lift system for use in producing a wellbore having perforations proximate a gas-bearing formation, the system comprising:

a dual-port packer adapted to seal the wellbore at a location above the perforations, the dual-port packer having two ports therein;

a tubing string adapted to deliver gas from the perforations proximate the formation via one port in the packer to a surface location, wherein the tubing string has a valve that is actuated in response to gas pressure in a well annulus outside the tubing string exceeding a predetermined level; and an injection tool separate from and not in contact with the tubing string and adapted to inject gas from a surface location into the wellbore at or below the perforations via the other port in the packer, the injection tool having a plurality of gas lift valves for delivering the injected gas into the wellbore at a location below the packer, wherein the injection tool is to receive a flow of gas and the plural gas lift valves are configured to be opened by pressure applied by the flow of gas to inject gas into the well, wherein the gas is injected through each of the gas lift valves that is opened to assist production of fluid from the wellbore.

24. The gas lift system of claim 23, wherein the injection tool is configured to be deployable into the wellbore separately from the tubing string.

25. A method for producing through a wellbore having a perforation interval proximate a formation, comprising:

injecting gas into the wellbore at or below the perforation interval, wherein injecting the gas comprises injecting the gas using an injecting tool having plural gas lift valves;

actuating a first one of the gas lift valves when the injected gas reaches a first pressure; actuating a second one of the gas lift valves when the injected gas reaches a second, greater pressure; and producing fluids from the wellbore using a tubing string that is separate from and not in contact with the injecting tool such that the gas lift valves are separate from the tubing string.

26. The method of claim 25, further comprising closing the first gas lift valve when the injected gas reaches the second pressure.

27. The method of claim 25, further comprising deploying the injecting tool into the wellbore separately from the tubing string.

* * * * *